US011045936B2

(12) United States Patent
Wang

(10) Patent No.: US 11,045,936 B2
(45) Date of Patent: Jun. 29, 2021

(54) STAPLE REMOVER

(71) Applicant: Yun L. Wang, Henderson, NV (US)

(72) Inventor: Yun L. Wang, Henderson, NV (US)

( * ) Notice: Subject to any disclaimer, the term of this patent is extended or adjusted under 35 U.S.C. 154(b) by 109 days.

(21) Appl. No.: 16/663,168

(22) Filed: Oct. 24, 2019

(65) Prior Publication Data

US 2021/0122021 A1 Apr. 29, 2021

(51) Int. Cl.
*B66F 15/00* (2006.01)
*B25C 11/02* (2006.01)

(52) U.S. Cl.
CPC ..... *B25C 11/02* (2013.01)

(58) Field of Classification Search
CPC ..... B25C 11/02; B25C 11/00; B25C 5/00; B25C 1/00; B66F 15/00
See application file for complete search history.

(56) References Cited

U.S. PATENT DOCUMENTS

| | | | | |
|---|---|---|---|---|
| 4,903,945 A | | 2/1990 | Wang | |
| 4,953,281 A | * | 9/1990 | Wang | B25C 11/02 29/438 |
| 5,195,724 A | * | 3/1993 | Koo | B25C 11/02 254/28 |
| 5,657,965 A | * | 8/1997 | Arias | B25C 11/02 254/28 |
| 5,918,859 A | * | 7/1999 | Qian | B25C 11/02 254/28 |
| 5,938,178 A | * | 8/1999 | Oh | B25C 11/02 254/28 |

* cited by examiner

*Primary Examiner* — Lee D Wilson
(74) *Attorney, Agent, or Firm* — Weiss & Moy, P.C.; Jeffrey D. Moy

(57) ABSTRACT

A staple removing device has a pair of levers pivotally coupled at one end on an axis such that their other ends are capable of movement toward one another. A bias spring acts on the pair of levers for biasing the pair of levers into an open position. A pair of extraction jaws on the other end of the pair of levers have engaging ends extending toward the other of the pair of levers for engaging the underside of a staple embedded in a material to lift the staple away from the material. A capture slot is formed one of the pair of levers that captures a staple when removed.

12 Claims, 3 Drawing Sheets

STAPLE REMOVER

RELATED APPLCIATIONS

This patent application is related to U.S. Pat. No. 4,903,945, issued on Feb. 27, 1990, entitled "STAPLE REMOVER" and U.S. Pat. No. 4,953,281, issued on Sep. 4, 1990 entitled "METHOD OF MAKING A STAPLE REMOVER" both in the Yun L. Wang, and which is incorporated herein by reference in its entirety.

FIELD OF THE INVENTION

This invention relates to a staple remover and, more particularly, to a staple extracting device with a pair of slots for capturing and holding the staple being removed, where the staple is removed without causing damage to the materials being held together thereby, and will uniformly withdraw the staple ends.

BACKGROUND OF THE INVENTION

Staple removers for removing whole and unbroken staples are well known. Most mechanical staple removers generally include hand grips and two pivoting jaws. Each jaw may have a pair of claws formed on the distal end thereof. The claws are operated in a pincer-like fashion. In use, the claws of the staple removers are positioned beneath the crown or uppermost exposed portion of the staple pin and pressure is applied to the grips. The claws may then engage the underside of the staple which will force the staple to ride up the claws. As the staple rides up the claws, the ends thereof will be unbent from their secured position to thereby be removed from the paper bundle. In general, most people will remove the staple from the claws upon which it rode-up upon.

While the design for a staple remover has been fairly constant, there continues to be a need for improved handling of removed staples.

SUMMARY OF THE INVENTION

In accordance with one embodiment a staple removing device is disclosed. The staple removing device has a pair of levers pivotally coupled at one end on an axis such that their other ends are capable of movement toward one another. A bias spring acts on the pair of levers for biasing the pair of levers into an open position. A pair of extraction jaws on the other end of the pair of levers have engaging ends extending toward the other of the pair of levers for engaging the underside of a staple embedded in a material to lift the staple away from the material. A capture slot is formed one of the pair of levers that captures a staple when removed.

In accordance with one embodiment, a staple removing device is disclosed. The staple removing device has a pair of levers pivotally coupled at one end on an axis such that their other ends are capable of movement toward one another. A bias spring acts on the pair of levers for biasing the pair of levers into an open position. A pair of extraction jaws on the other end of the pair of levers have engaging ends extending toward the other of the pair of levers for engaging the underside of a staple embedded in a material to lift the staple away from the material. A capture slot is formed in one of the pair of levers that captures a staple when removed, wherein the capture slot is formed at an angle, the angle of the capture slot is approximately an angle of the extraction jaws.

BRIEF DESCRIPTION OF THE DRAWINGS

The present invention is further detailed with respect to the following drawings that are intended to show certain aspects of the present invention, but should not be construed as a limit on the practice of the present invention.

It is understood that like reference characters refer to like elements throughout the several figures.

DESCRIPTION OF THE INVENTION

Figure 1:
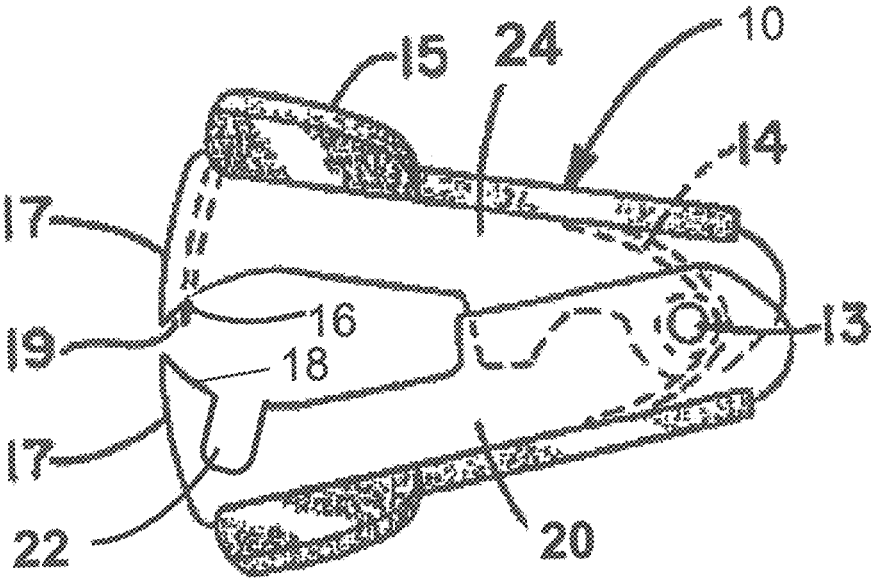
FIG. 1 is a side view of an embodiment of an extraction device with a capture slot in accordance with the invention.
Figure 2:
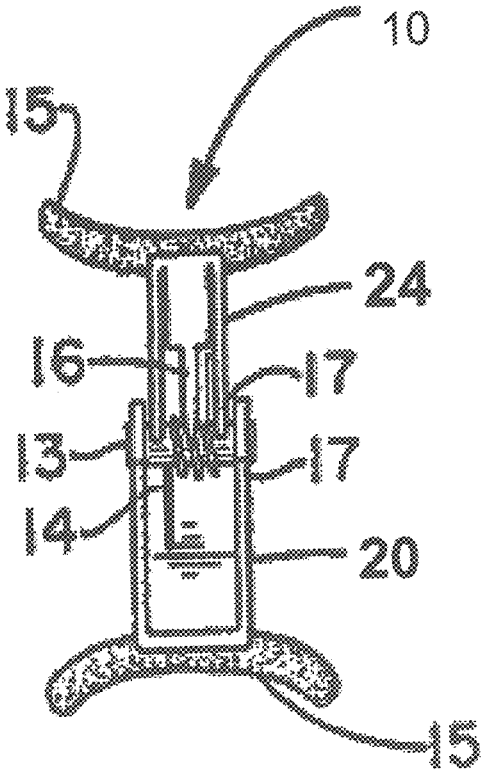
FIG. 2 is a front view of the apparatus of FIG. 1 showing the extraction jaws and engaging member thereof.

The preferred embodiments of the present invention will be hereinafter described with reference to the figures. As shown in FIGS. 1 and 2, an embodiment of the present inventive extraction device is shown generally by reference numeral 10. The device 10 includes two levers, 20 and 24, pivotally connected at one end by a pin 13 extending through apertures therein. The levers 20 and 24 are shown in an open position, and being spring biased in this position by spring 14. The levers 20 and 24 are, therefore, able to pivot toward one another at the opposite end of coupling. The levers 20 and 24 provided with thumb or finger rests 15 such that a force may be applied with a user's hand to pivot the levers 20 and 24. Lever 20 has a slot 22 that captures staples as the staples are removed from a substrate such as one or mote sheets of joined paper as will be further described below.

At the opposite end from coupling on the levers 20 and 24, are provided extraction jaws 17 having a pair of respective points engaging ends thereon for engaging a staple which is embedded in a paper bundle or the like. This structure is seen more clearly with reference to FIG. 2, wherein the extraction jaws 17 are more clearly shown with a pair of points formed on each respective jaw. The jaws 17 enable engagement with the head of a staple which is embedded in a paper bundle for extraction. The extraction jaws 17 provide a tapering surface 18 upon which the engaged staple will ride up when the levers 20 and 24 are pivoted towards one another, thereby extracting the embedded staple. As the engaged or captured staple progresses along the tapering surface 18 of lever 20 the staple encounters slot 22 that entraps the staple and holds the staple as the device 10 is pulled away from the paper bundle. The slot 22 is formed at an angle. The angle of the slot 22 is similar to the angle of the extraction jaws 17.

The lever 24 has a projection or engaging member 16. The engaging member 16 may be positioned within a slot 19 formed between the extraction jaws 17 formed on the lever 24. The engaging member 16 is similar to that disclosed in U.S. Pat. No. 4,903,945 to Wang. The engaging member 16 may include a section having a greater width extending between the points of the extraction jaw 17 so as to provide reinforcement to the end thereof as shown in FIGS. 2 and 3.

The member 16 is simply stamped in conjunction with the lever 24 and is then bent into its position between and adjacent the points of extracting jaw 17. The lever 20 is constructed similarly to that of a presently known device, and includes, the extracting jaw 17 and tapered surfaces 18 which will be bent into their U-shaped. The engaging member 16 may be incorporated in either lever, as desired, and will function in the same manner as described. The engaging member 16 holds down the center of the staple to be removed as the ends of the staple are lifted by the levers 24 and 20.

Figure 3:
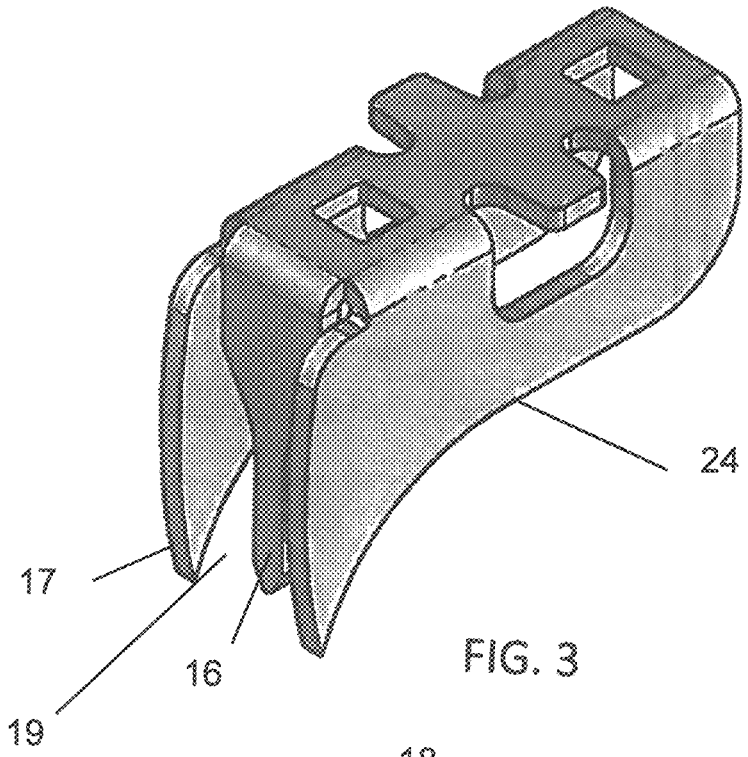
FIG. 3 is a perspective view of an upper lever of the apparatus of FIG. 1 with an engaging member in accordance with embodiments of the invention.
Figure 4:
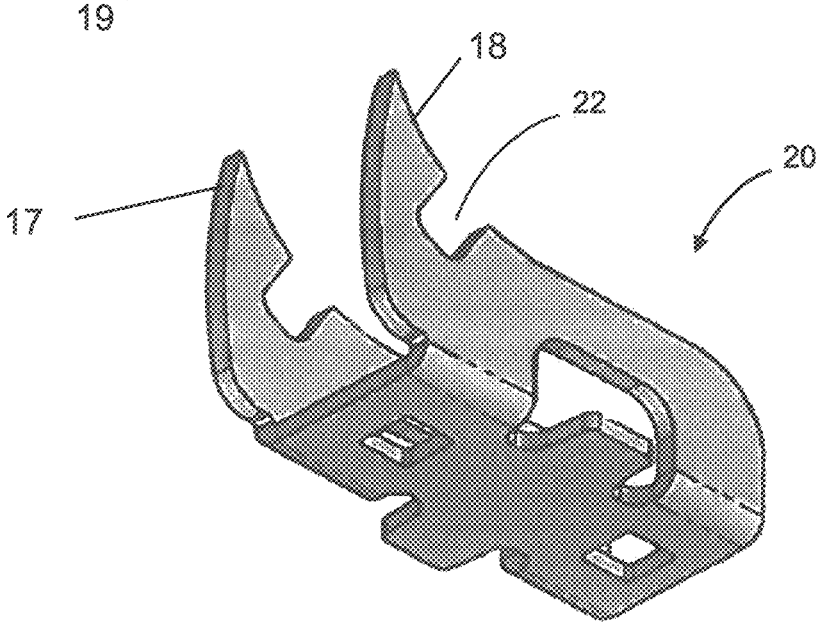
FIG. 4 is a perspective view of a lower lever of the apparatus of FIG. 1 with a slot for capturing removed staples in accordance with embodiments of the invention.

FIGS. 3 and 4 are perspective views of an embodiment of an inventive lower lever 20 with a slot 22 for capturing removed staples and the invent on upper lever 24 with the engaging member 16 respectively.

Figure 5A:
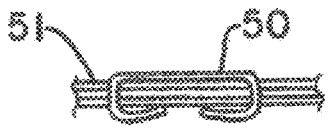
FIGS. 5A-5E show the sequence of staple extraction using the embodiments of the present invention.
Figure 5B:
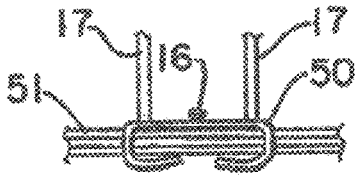
Figure 5C:
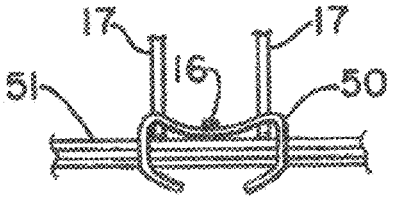
Figure 5D:
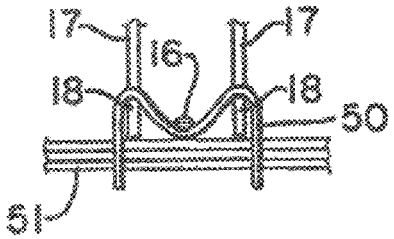

FIGS. 5A-5E illustrate the operation of the device 10 and shows different stages of operation to extract a staple 50 embedded in a paper bundle 51 or the like as shown in FIG. 5A. The extraction jaws 17 associated with the lever 24 is shown in FIG. 5B and it is to be understood that the opposite lever 20 (not shown) will be engaging the staple 50 from the other side thereof for extraction of the staple and for capture in slot 22. Engaging member 16 is shown as engaging the top portion of the staple 50 at a location near the middle thereof. The engaging member 16 may engage the staple 50 either simultaneously with or immediately after engagement of the points on extraction jaw 17 with the underside of staple 50. As shown in FIG. 5C, the engaging member 16 will act to anchor the center of the staple 50 against the paper bundle 51 while the points of extraction jaw 17 lift the edges of the staple away from the paper. As the levers 24 and 22 are brought together, the staple 50 will be made to ride up the tapered surface 18 thereby straightening the ends and extracting the staple cleanly from the paper bundle 51 as shown in FIG. 5D. The engaging member 16 still retains the middle portion of staple 50 anchored at a location near the paper in the formed slot 19. By the anchoring operation of engaging member 16, the two staple legs are straightened independently and completely such that they are uniformly withdrawn from the paper bundle 51. The engaging member 16 will ensure that the force or straightening action applied to each of the staple legs is identical so that there is no possibility of a staple leg being retained in the paper bundle 51. It can be seen that the complete straightening of the legs on staple 50 by the action of engaging member 16 facilitates uniform withdrawal of the legs and proper removal of the staple without damaging or tearing the paper 51.

Figure 5E:
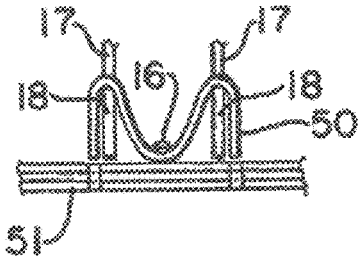

As the levers 24 and 20 are continually forced together, the staple 50 will be completely removed from the paper bundle 51 and is bent into a position as shown in FIG. 5E wherein the legs of the staple 50 will be drawn back from the gap 19 between the tapered surface 18 of the extraction jaw 17 and engaging member 16. The engaging member 16 forces the staple to be captured within the slots 22 of the lever 20. In this way, the staple will have a raised portion at the middle thereof after removal from the paper bundle 51 which creates pressure on the legs of the staple 50 to retain the staple within the slots 22 and to facilitate easy grasping for disposal thereof when captured in slots 22 of lever 20.

Figure 6A:
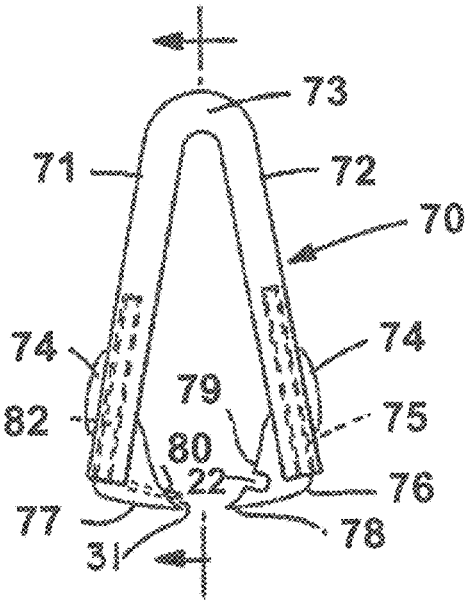
FIG. 6A is a side view of an alternate embodiment of the present invention.
Figure 6B:
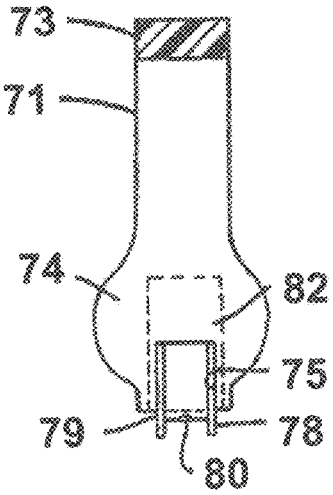
FIG. 6B is a cross-sectional view taken along the line 6-6 of FIG. 6A.

An additional inventive embodiment is shown with reference to FIGS. 6A and 6B wherein the extraction device is generally shown by reference numeral 70. The device 70 again comprises two levers 71 and 72 which are able to pivot towards one another from an initial open position. The levers 71 and 72 are formed integrally with a curved portion 73 providing the bias force necessary to keep the device in an initially opened position. The levers 71 and 72 and curved portion 73 are made of a resilient plastics material which will enable pivoting of levers 71 and 72 towards one another and will then spring back to its original shape and open position. The use of such a plastics material obviates the need for separate levers which are coupled by a pin as shown in FIG. 1. The levers 71 and 72 may also be integrally formed with a thumb or finger rest 74 therein similarly to that shown in FIG. 1, but not requiring any fastener. The device 70 may be formed by molding the plastics material, and also comprises a pair of slots 75 formed in the ends of levers 71 and 72. The slots 75 are produced to enable engagement with separate extracting jaw members 76 and 77. The extracting jaws 76 and 77 are formed similarly to that shown in FIG. 1 with points 78 having tapering surfaces 79 therefrom. As seen with reference to FIG. 6B, the extracting jaws may be provided with a plate portion 82 which fits into the slotted portion 75 of the levers 71 and 72 to frictionally retain the extracting jaws therein. This structure eliminates the need for additional fasteners, but the extracting jaws 76 and 77 may he fastened to the levers 71 and 72 by any suitable fastening means if desired. A separate engaging member 80 is provided which extends between the points of extracting jaw 77 similarly to member 16 of FIG. 1. Capture slot 22 in extracting jaw member 76 collects staples as the staples are extracted from a paper bundle.

It can be seen that the present invention improves the function of a staple removing device such that the staple may be easily removed without damaging or caring the paper in which it is embedded, and it will extract the legs of a staple uniformly so that the staple is assuredly removed from the paper. It is seen that with capturing slot and in specific embodiments the separate engaging member, as shown in the embodiments of the present invention, the objects and advantages of the present invention are realized in a very cost effective and easily manufactured method to provide an improved structure. While the preferred embodiments of the present invention have been disclosed herein, it will be appreciated that modification of these particular embodiments of the invention may be resorted to without departing from the scope of the invention as found in the appended claims.

Various modifications of the present invention, in addition to those shown and described herein, will be apparent to those skilled in the art of the above description. Such modifications are also intended to fall within the scope of the appended claims.

The foregoing description is illustrative of particular embodiments of the invention, but is not meant to be a limitation upon the practice thereof. The following claims, including all equivalents thereof, are intended to define the scope of the invention.

The invention claimed is:

1. A staple removing device comprising:

a pair of levers pivotally coupled at one end on an axis such that their other ends are capable of movement toward one another;

a bias spring acting on said pair of levers for biasing said pair of levers into an open position;

a pair of extraction jaws on said other end of said pair of levers having engaging ends extending toward the other of said pair of levers for engaging the underside of a staple embedded in a material to lift said staple away from said material;

a capture slot in one of said pair of levers that captures a staple when removed; and an engaging member attached to one of said levers and located adjacent said extraction jaw extending substantially parallel to said extractions jaw but spaced therefrom for engaging the top side of a staple at about the center thereof simultaneously with engagement of said engaging ends of said extraction jaws with the underside of said staple;

said engaging member extends at least to a plane which includes said engaging ends of said extraction means and said pivotal axis of said levers; and wherein said engaging member will anchor said staple to said material at a middle portion thereof and the extraction jaws will uniformly withdraw the staple ends for removal.

2. The staple removing device of claim 1, wherein said capture slot is formed on a lower lever of said pair of levers.

3. The staple removing device of claim 1, wherein said capture slot is formed on a lower lever of said pair of levers on opposing tapering sections of said lower lever.

4. The staple removing device of claim 1, wherein said capture slot is formed on a lower lever of said pair of levers and is formed at an angle.

5. The staple removing device of claim 4, wherein the angle of the capture slot is approximately an angle of said extraction jaws.

6. The staple removing device of claim 1, wherein said capture slot is formed at an angle.

7. The staple removing device of claim 1, wherein said capture slot is formed at an angle, said angle approximately an angle of said extraction jaws.

8. The staple removing device of claim 1, wherein said levers are constructed of a stamped metal sheet and coupled by means of a pin at one end thereof;

said engaging ends of said extraction jaws further comprising a pair of points wherein said extraction jaws have a tapering surface from said points back toward said levers.

9. The staple removing device of claim 8, wherein said engaging member will anchor the staple upon engagement therewith such that the force applied by said extraction jaws will be equalized on either side of said engaging jaws for uniform withdrawal of the staple.

10. The staple removing device of claim 8, wherein said engaging member acts in conjunction with said extraction jaws so as to independently lift the legs of the staple for removal thereof.

11. The staple removing device of claim 8, wherein said engaging member comprises a section having a greater width for reinforcement thereof.

12. The staple removing device of claim 8, wherein said engaging member is constructed as an integral portion of said lever to which it is attached.

* * * * *